United States Patent [19]

Lang et al.

[11] Patent Number: 4,633,680

[45] Date of Patent: Jan. 6, 1987

[54] DOUBLE WALL CONDENSER ORIFICE

[75] Inventors: Richard D. Lang, Chittenango; James E. Napolitano, Liverpool, both of N.Y.

[73] Assignee: Carrier Corporation, Syracuse, N.Y.

[21] Appl. No.: 778,116

[22] Filed: Sep. 20, 1985

[51] Int. Cl.[4] ..... F25B 39/04

[52] U.S. Cl. ..... 62/507; 62/262; 62/263; 165/121

[58] Field of Search ..... 62/262, 263, 506, 507; 165/121, 122

[56] References Cited

U.S. PATENT DOCUMENTS

| | | | |
|---|---|---|---|
| 3,173,478 | 3/1965 | Maycen | 165/121 |
| 3,645,107 | 2/1972 | Quick | 62/507 |
| 3,766,751 | 10/1973 | Ball | 62/280 |
| 3,838,579 | 10/1974 | Ballard | 62/262 |
| 4,129,996 | 12/1978 | Hardin et al. | 62/262 |
| 4,202,405 | 5/1980 | Berg | 165/122 |
| 4,321,803 | 3/1982 | Smith | 62/507 |
| 4,446,914 | 5/1984 | Russell | 165/129 |

*Primary Examiner*—Ronald C. Capossela

*Attorney, Agent, or Firm*—Dana F. Bigelow

[57] ABSTRACT

Integrally formed with a molded plastic housing for a room air conditioner, is a pair of axially spaced walls whose inner edges closely surround the periphery of the condenser fan such that the dead air space created between the walls tends to prevent the recirculation of air around the fan periphery when the fan is in operation.

6 Claims, 3 Drawing Figures

DOUBLE WALL CONDENSER ORIFICE

BACKGROUND OF THE INVENTION

This invention relates generally to air conditioning systems and, more particularly, to a condenser fan orifice design for a room air conditioner.

Conventional room air conditioners include outdoor and indoor sections, with the outdoor section including a condenser coil and a fan for blowing outside air over the condenser coil, while the indoor section includes an evaporator coil and a fan for blowing indoor air over the evaporator coil.

The outdoor portion typically has the condenser coil located at the outer end of the unit, with the fan being positioned adjacent thereto for directing outdoor air outwardly through the condenser coil. That space between the fan and the condenser coil is then referred to as the high pressure side of the fan and the other side is referred to as the low pressure side wherein outdoor air is drawn in through the side walls by the fan. Inasmuch as the air conditioning unit is normally rectangular rather than round in shape, the boundary between the high and low pressure sides is defined, in addition to the fan, by a so-called "condenser fan orifice wall" which extends radially inwardly from the unit housing to closely surround the condenser fan. In addition, to reduce recirculation, or tip losses, it has become customary to provide, at an axial extension of the fan orifice wall, a cylindrical fan orifice ring which closely surrounds the fan to prevent the migration of air from the high pressure to the low pressure side of the fan. This is commonly done by mechanically attaching the fan orifice ring to the fan orifice wall by welding or the like.

Traditionally, the housing structure for room air conditioning systems has been fabricated from metal material.

Accordingly, it was a relatively simple matter to weld in a fan orifice wall and associated fan orifice ring. Recently, however, use has been made of synthetic materials such as polymerics for the housing structure. With such materials, the orifice can be separately molded and then attached to the housing or the orifice wall by fasteners or the like.

A particular housing design utilizing molded materials is that shown in U.S. patent application Ser. No. 778,113 filed concurrently herewith and assigned to the assignee of the present invention. In that design, the fan orifice wall is molded as an integral part of the housing. Whereas it would be desirable to also mold the fan orifice ring as an integral part thereof, it is not possible to do so because of the axial orientation of the conventional fan orifice ring. An alternative is to attach a separate fan orifice ring element to the fan orifice wall by conventional fastening means such as screws or the like. However, there is a possibility that the ring may come loose to cause noise, or worse, to cause damage to the fan, fan motor or compressor. Further, to make such an attachment is time consuming and costly during the assembly process.

It is therefore an object of the present invention to provide an improved fan orifice ring structure for an air conditioning housing made from synthetic materials.

Another object of the present invention is the provision for a fan orifice ring structure to be used in combination with an orifice wall made from a synthetic material.

Still another object of the present invention is the provision in an air conditioning unit having a fan orifice wall formed of a synthetic material, for a fan orifice ring which is not susceptible to movement within the housing.

Yet another object of the present invention is the provision for an air conditioner housing with an integral fan orifice wall and fan orifice ring which is economical to manufacture and efficient to use.

These objects and other features and advantages become more readily apparent upon reference to the following description when taken in conjunction with the appended drawings.

SUMMARY OF THE INVENTION

Briefly, in accordance with one aspect of the invention, a pair of axially spaced, radially extending, fan orifice wall structures are formed on the inner side of a molded air conditioner housing. One of the fan orifice wall structures is of the same form, and located in the same position, as a conventional fan orifice wall. The other orifice wall structure is of the same form but is located downstream (i.e. toward the high pressure side of the fan) from the first fan orifice wall structure. The resulting dead air space which is created between the two fan orifice wall structures is functionally similar to the barrier which is created by a conventional orifice ring in that it significantly diminishes the recirculation of air from the high pressure to the low pressure side of the fan.

In the drawings as hereinafter described, a preferred embodiment is depicted. However, various other modifications and alternate constructions can be made thereto without departing from the true spirit and scope of the invention.

DESCRIPTION OF THE PREFERRED EMBODIMENT

Figure 1:
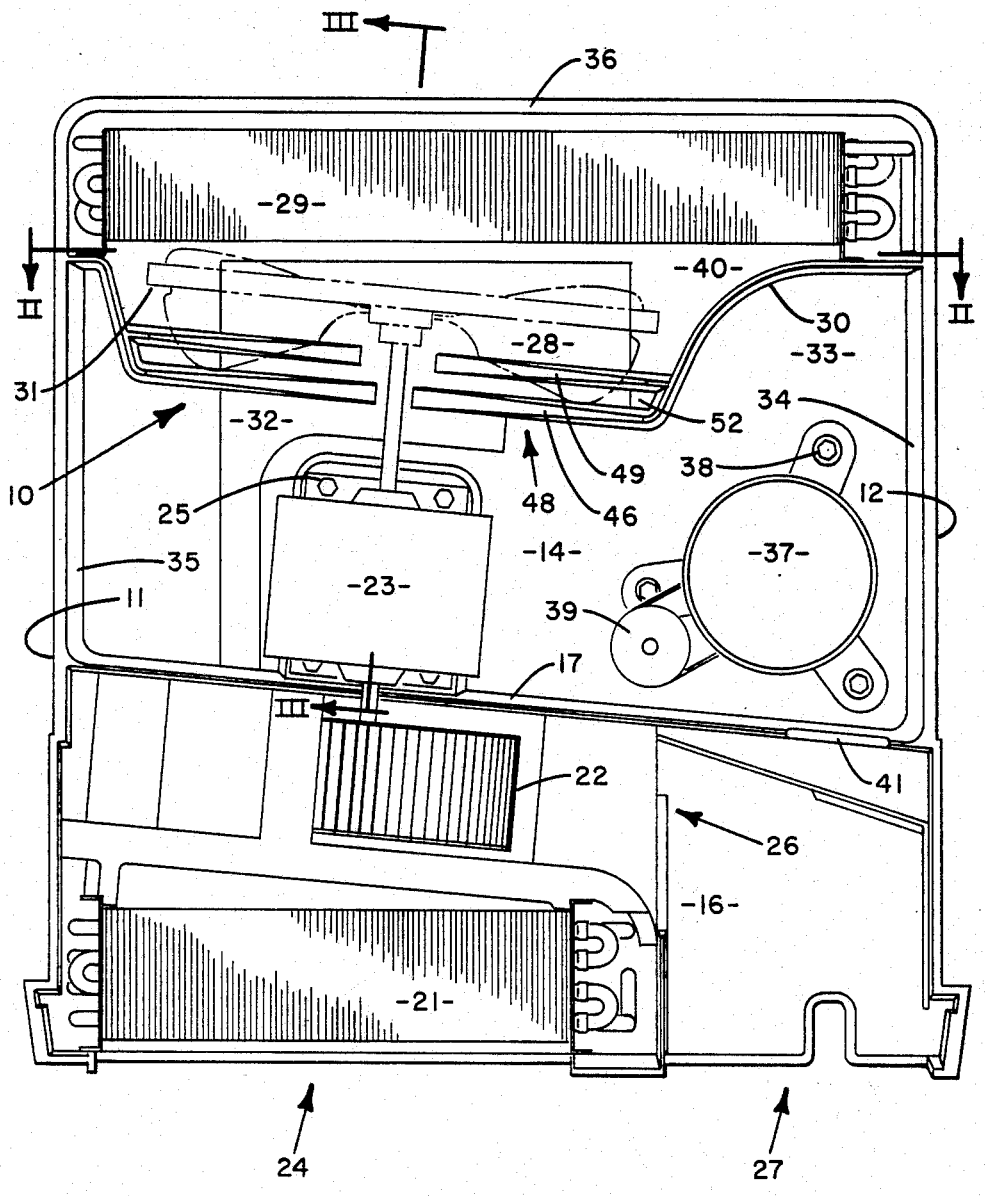
FIG. 1 is a top view of a room air conditioner with the top cover removed to show the lower half of a condenser fan orifice in accordance with a preferred embodiment of the invention.
Figure 2:
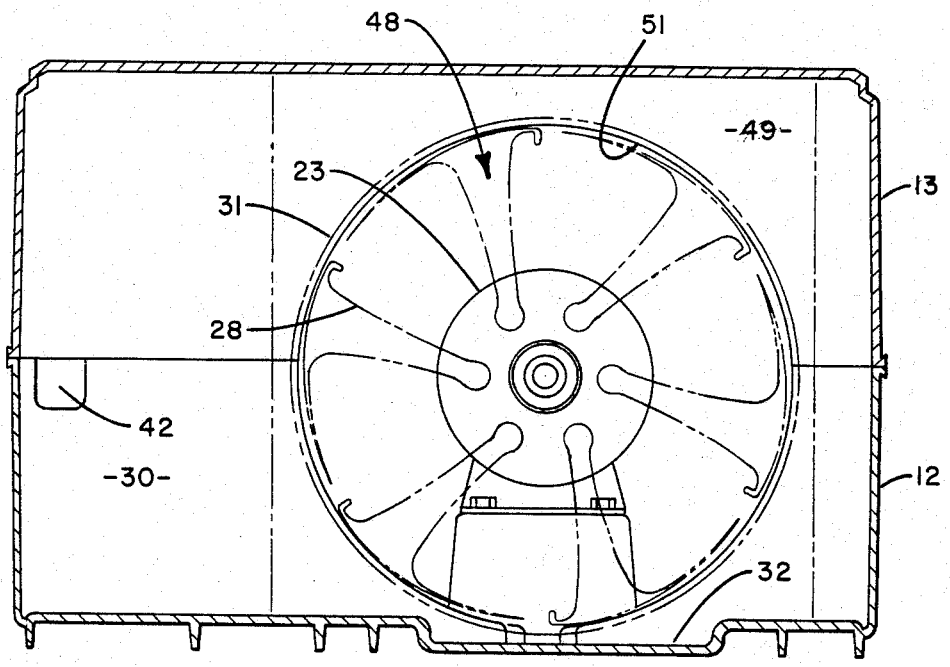
FIG. 2 is a sectional view thereof as seen along lines 2—2 of FIG. 1, but with the top cover in place.

Referring now to the drawings, the invention is shown generally at 10 as applied to a room air conditioner 11 which includes a lower housing element 12 and upper housing element 13 which, together, form the basic supporting and covering structure for the system. The housing elements are preferably fabricated from a molded plastic material, such as, for example, polypropylene.

Figure 3:
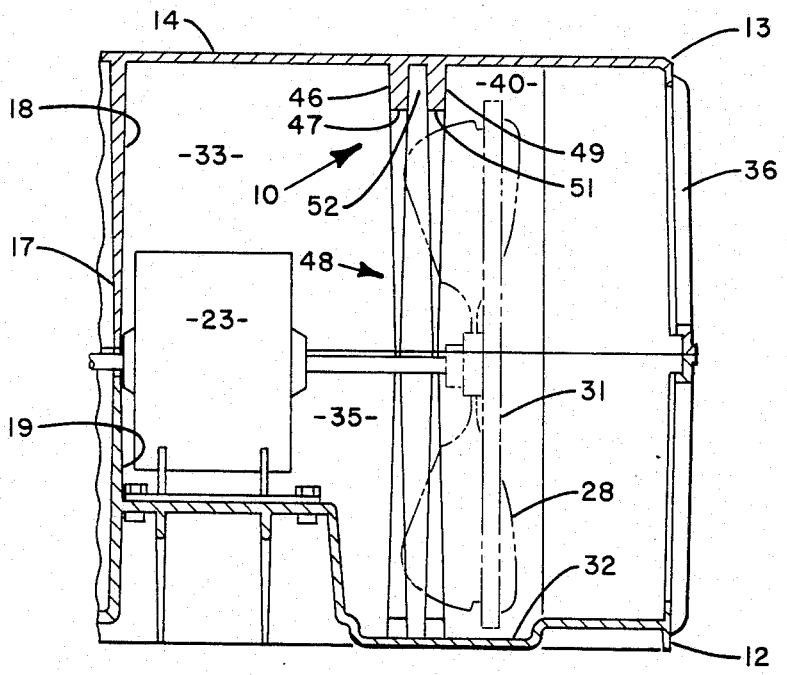
FIG. 3 is a partial sectional view, as seen along lines 3—3 of FIG. 1, but with the top cover in place.

The system comprises generally an outdoor section 14 and an indoor section 16, with the boundary therebetween being defined by a partition 17 comprised of upper and lower partition elements 18 and 19, respectively, as shown in FIG. 3.

The indoor section 16 includes an evaporator coil 21 and a centrifugal blower 22 which is driven by a motor 23 located in the outdoor section of the system. The blower 22 operates to draw room air through a grille (not shown) and into the intake opening 24, through the evaporator coil 21, through the evaporator scroll outlet 26, and out the side discharge opening 27 into the room.

Within the outdoor section 14, the motor 23 is mounted to the lower surface of the housing element 12 by a plurality of fasteners 25. In addition to driving the centrifugal blower 22 within the indoor section, the motor 23 drives the fan 28 which operates to blow outdoor air over the condenser coil 29 (not shown in FIG. 3). The fan 28 has an integrally attached condensate ring 31 which operates to scoop up liquid condensate from the condensate pan 32 and cause it to be blown against the condenser coil 29 to thereby improve its efficiency.

A wall 30 defines the boundary between a low pressure compartment 33 and a high pressure compartment 40. In operation, the fan 28 draws outdoor air into the low pressure compartment 33 from the side louvers (not shown) at the sides 34 and 35, with the air then passing through an orifice (to be defined hereinafter) and into the high pressure compartment 40. It then passes through the condenser coil 29 and out the air discharge openings (not shown) at the rear side 36 of the housing.

As will be seen in FIG. 1, the condenser coil 29 is generally symmetrically located with respect to the housing, while the evaporator coil 21 is offset to one side to accommodate the side discharge arrangement. Accordingly, in order to locate the centrifugal blower 22 centrally with respect to the evaporator coil 21, while at the same time locating the fan 28 somewhat centrally with respect to the condenser coil 29, it is necessary to install the motor 23 with its shaft in an oblique disposition as shown.

At the side of the motor 23 there is a compressor 37, which is secured to the housing by a plurality of fasteners 38, and an associated accumulator as shown at 39. Although not shown, the compressor 37 is fluidly connected to the evaporator coil 21 by piping which passes through the opening 41 in the partition 17. Similarly, the compressor 37 is fluidly connected to the condenser coil 29 by piping which passes through an opening 42 in the wall 30.

Formed as an integral part of the wall 30 is a first wall 46 which extends radially inwardly to define at its inner edge 47 a condenser fan orifice 48. This first condenser fan orifice wall 46 is comprised of upper and lower halves which are integrally formed as part of the upper and lower housing elements 13 and 12, respectively. As will be seen in FIG. 3, this first wall 46 is axially located at the leading edge of the fan 28 and functions to prevent the fan 28 from throwing water out the louvers in the side walls 34 and 35.

Axially spaced from the first wall 46, in the downstream direction, is a second wall 49 which, like the first wall 46, is integrally formed as an extension of the wall 30. The second condenser fan orifice wall 49 is of substantially the same dimensions as the first wall 46 such that it too helps to define at its inner edge 51, the condenser fan orifice 48. Between the first and second walls 46 and 49, is an axial gap 52 which creates a dead air space when the fan 28 is operating. Functionally then, the first and second walls 46 and 49, together with the included gap 52, serve the same purpose as a single wall with an attached orifice ring in that they substantially reduce the recirculation of air (i.e. tip losses) between the high and low pressure sides 40 and 33, respectively. However, the double wall orifice structure as shown can be integrally molded as part of the upper and lower housing elements 13 and 12 in a single molding operation, and without the need to attach an additional element as was conventionally done in the prior art.

While the present invention has been disclosed with particular reference to a preferred embodiment, the concepts thereof are readily adaptable to other embodiments, and those skilled in the art may vary the structure thereof without departing from the essential spirit of the present invention.

What is claimed is:

1. In an air conditioning system of the type having a heat exchanger and a fan positioned to direct the flow of air thereover, with both the heat exchanger and the fan being contained in a housing with a wall surrounding the fan periphery to form an orifice gap therebetween, an improved orifice wall assembly comprising:

a first wall attached to the inner side of the housing in surrounding relationship with said fan, said first wall extending radially inwardly toward said fan to thereby reduce said orifice gap and diminish the recirculation of air around the fan periphery: and a second wall attached to the inner side of the housing, said second wall being axially disposed downstream from and in parallel relationship with said first wall, in surrounding relationship with the fan, and extending radially inwardly to create a gap between said first and second walls to further diminish the recirculation of air around the periphery of the fan.

2. An orifice wall assembly as set forth in claim 1 wherein said first wall is axially disposed near the leading edge of the fan.

3. An orifice wall as set forth in claim 1 wherein said first and second walls are formed as an integral part of said housing.

4. In a room air conditioner of the type having outdoor and indoor sections with the outdoor section having a generally radially extending fan orifice wall formed of molded upper and lower housing portions to define the boundary between high and low pressure sides of the condenser fan concentrically disposed therein, an improved fan orifice ring assembly comprising:

another fan orifice wall axially spaced from the first fan orifice wall and extending radially inwardly from the upper and lower housing portions to provide a dead air space between the fan orifice walls for preventing the recirculation of air from the high to the low pressure side of the fan.

5. The fan orifice ring assembly as set forth in claim 4 wherein said other fan orifice wall is formed as an integral part of the upper and lower housing portions.

6. An improved condenser fan orifice wall structure for a room air conditioner of the type having an outdoor section with a wall having an orifice formed therein for receiving the condenser fan comprising:

a first wall extending radially inwardly to an inner edge which closely surrounds the condenser fan;

a second wall axially disposed from said first wall and extending radially inwardly to an inner edge which closely surrounds the condenser fan; and said first and second wall defining an axial gap therebetween to create a dead air space when the fan is in operation to thereby decrease the tip losses at the periphery of the fan.

* * * * *